US006009652A

United States Patent [19]

Smith

[11] Patent Number: 6,009,652

[45] Date of Patent: Jan. 4, 2000

[54] SIGN CONSTRUCTION

[76] Inventor: David A. Smith, 1135 CR 620, Ashland, Ohio 44805

[21] Appl. No.: 08/908,367

[22] Filed: Aug. 7, 1997

[51] Int. Cl.[7] ..... G09F 7/00

[52] U.S. Cl. ..... 40/610; 40/617; 40/606

[58] Field of Search ..... 40/606, 610, 617, 40/618; 24/716, 545, 488, 511, 512, 460; 248/545, 156, 175

[56] References Cited

U.S. PATENT DOCUMENTS

| | | | |
|---|---|---|---|
| 1,573,101 | 2/1926 | Steckol | 40/617 |
| 2,814,140 | 11/1957 | Ellis | 40/617 |
| 3,625,352 | 12/1971 | Brooks et al. | 40/377 |
| 4,103,445 | 8/1978 | Smith et al. | 40/610 |
| 4,817,319 | 4/1989 | Vitale | 40/610 |
| 4,916,840 | 4/1990 | Getz | 40/605 |

*Primary Examiner*—Cassandra H. Davis

*Attorney, Agent, or Firm*—Pearne, Gordon, McCoy & Granger LLP

[57] ABSTRACT

An outdoor sign construction comprising an inverted U-shaped wire frame and a rectangular corrugated plastic face panel. The sign face panel is retained on a horizontal header section of the frame between vertical frame legs by a resilient extruded plastic channel assembled around the header and out the top edge of the panel. The panel can be allowed to swing on the frame header or can be fixed against such movement by optional brackets. A secondary header and auxiliary sign panel can be assembled on the frame.

17 Claims, 2 Drawing Sheets

SIGN CONSTRUCTION

BACKGROUND OF THE INVENTION

The invention relates to outdoor signs and, in particular, to temporary ground signs.

PRIOR ART

Sign manufacturers currently use a plastic sheet product commonly known as corrugated plastic for face material of temporary and/or inexpensive signs. Typically, vinyl graphics comprising letters or other images cut out of adhesive backed colored vinyl sheet are applied to such corrugated sheets at local sign shops. In outdoor usage, it is common to construct a ground sign with a leg or legs that can be driven into the ground to anchor the sign and support the face or faces. Attempts have been made to utilize corrugated plastic material for outdoor ground signs but the results have often been unsatisfactory. Known constructions are subject to wind damage or to damage from light impacts. Additionally, certain sign frames present a risk of injury should a person fall against upstanding barbs of the frame that are inserted into the corrugations of the sign face material to effect their assembly.

SUMMARY OF THE INVENTION

The invention provides a durable and inexpensive outdoor ground sign assembled from corrugated plastic sign face material and metal rod. The frame is in the shape of an inverted U and the sign face is hung from the horizontal bight portion of the frame. An extruded plastic channel snaps over the horizontal frame bight section and grips the faces of the corrugated sheet or panel. The assembly procedure is relatively simple and very quick thereby reducing labor cost. The channel remains loose on the frame and enables the sign to resist strong winds and impacts by allowing the sign face panel to swing upwardly to reduce its effective area and wind resistance and/or to absorb impact energy.

In situations where it is desirable to stabilize the sign face panel against swinging such as by customer preference or local zoning ordinances, the sign is provided with clip elements that fasten the lower edge of the sign face panel to adjacent areas of the legs. The clip elements are configured to securely hold the sign face panel while avoiding projecting elements which could pose a risk to a person in the event he or she accidentally fell against it.

One or more additional sign face panels can be assembled on the frame. In this optional construction, a secondary cross bar is joined to the legs and an additional corrugated plastic sign face panel is mounted on the secondary bar. The assembly is accomplished with an extruded retaining channel like that used with the main part of the frame and the sign face panel associated with it as described above.

DESCRIPTION OF THE PREFERRED EMBODIMENTS

Figure 1:
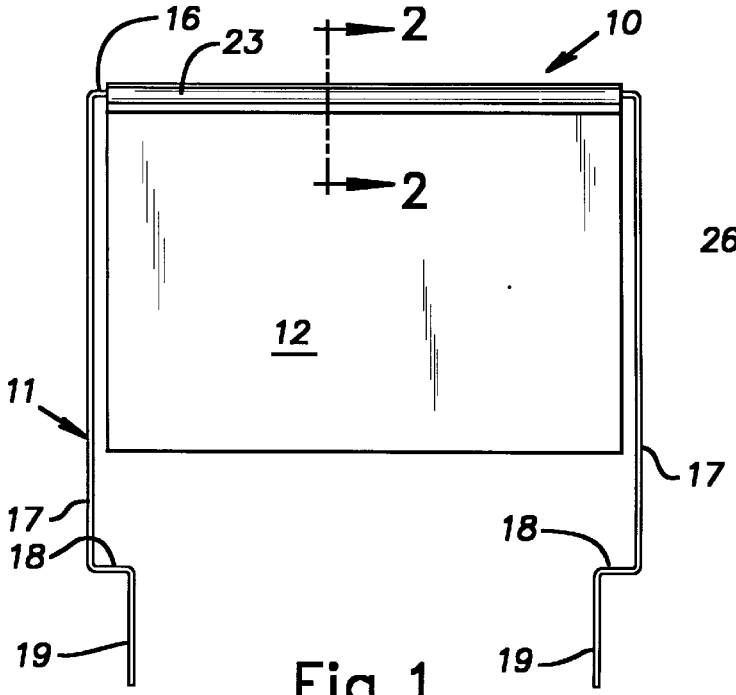
FIG. 1 is an elevational view of a sign constructed in accordance with the invention.

A sign assembly 10 constructed in accordance with the invention is a generally planar rectangular assembly of a rigid metal frame 11 and a sign face panel 12. The frame 11 is preferably formed of steel or other suitable metal wire or rod. The frame can be made of ¼" diameter galvanized steel wire or rod. Other coating may be applied to the steel wire such as cadmium or paint to provide a protective cover. The frame 11 is fabricated by cold bending a continuous piece into a generally U-shaped configuration that is inverted when used. The U-shape includes a horizontal header or bight portion 16 and symmetrical generally vertical legs 17 depending integrally from the header. The legs 17 are bent with a horizontal offset 18 that forms a foot step to facilitate installation of respective lower portions 19 of the legs 17 into ground. The offsets 18 are each in the plane of the sign assembly 10 and directed towards the opposite leg 17.

The sign face panel 12 is a relatively rigid sheet preferably formed of thermoplastic material such as copolymer polypropylene and known in the sign industry as corrugated plastic. The corrugations or flutes are shown in section in FIG. 5 and are formed by parallel vertical webs 21 that are integrally attached to outer sheets or skins 22 of the sign face panel 12. As shown, the sign panel 12 is largely hollow owing to the corrugation spaces between the webs 21.

Figure 2:
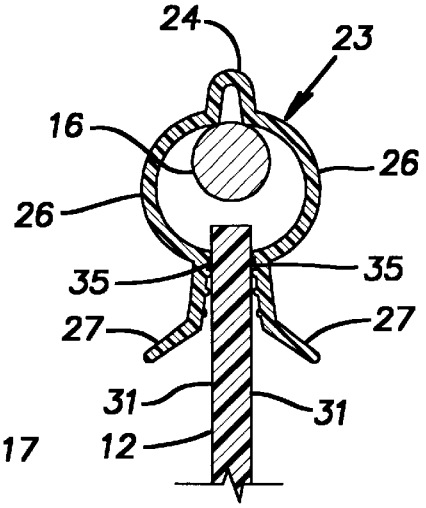
FIG. 2 is a fragmentary cross-sectional view of the sign taken across the plane indicated by the lines 2—2 in FIG. 1.

The sign assembly 10 includes an extruded thermoplastic channel 23 of suitable material such as polyvinylchloride of a known type such as used in residential siding and window construction and resistant to ultraviolet light. The length of the extrusion or channel 23 ideally is substantially equal to the width of the sign panel 12. By way of example, the sign panel illustrated in FIG. 1 can have a nominal height of 18" and a nominal width of 24". The channel 23 has a somewhat circular cross-section and includes an arcuate U-shaped bight 24 (FIG. 2) and opposed flanges 26. Desirably, the flanges 26 have outwardly flared portions 27 at their free edges. The plastic material of the channel 23 has sufficient resilience to allow it to be snapped over the frame header 16 and to tightly grip the upper edge of the sign panel 12 on its opposite faces with the flanges 26. The re-entrant arcuate or bulbous cross-section of the channel 23 allows its flanges 26 to firmly grip the sign panel 12 while affording a clearance fit around the frame header 16. As a result, the sign panel 12 and channel 23 when installed on the header 16 can swing or pivot about the horizontal axis of the header. This swinging capability allows the sign to withstand strong winds and impacts. When a strong wind occurs, the panel 12 can swing upwardly and reduce its effective face area and thereby reduce the wind force on the sign 10. Similarly, when the panel 12 is struck with an object, it can deflect by pivoting on the header 16 to absorb the energy of the impact. Preferably, the sign panel 12 is arranged so that the longitudinal direction of the corrugation webs 21 is perpendicular to the length of the channel 23. This orientation allows the channel 23 to rigidify and reinforce the sign panel 12 in the direction it is weakest. Preferably, a suitable adhesive or bonding agent 35 such as cyanoacrylate can be used to bond the channel flanges 26 to the faces 31 of the panel 12.

Figure 3:
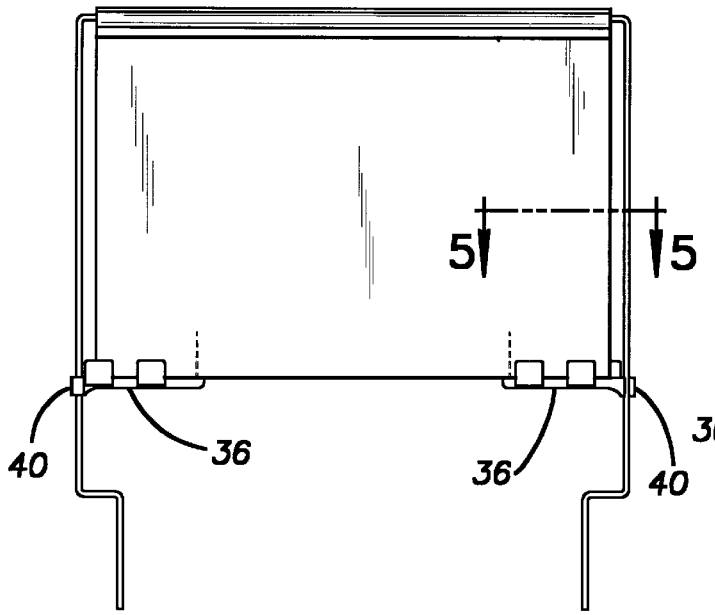
FIG. 3 is an elevational view of the sign assembled with accessory clips for locking the sign face panel to the frame legs.
Figure 4:
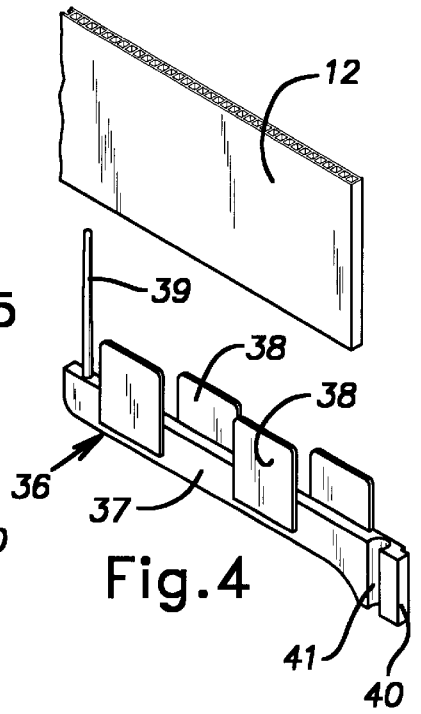
FIG. 4 is a fragmentary exploded perspective view of a typical clip and a portion of the sign face panel.
Figure 5:
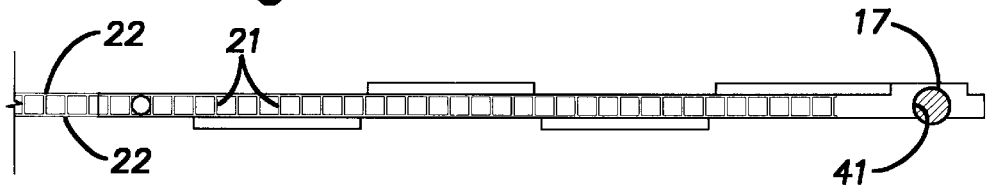
FIG. 5 is a fragmentary cross-sectional view through the sign taken at the plane 5—5 indicated in FIG. 3.

With reference to FIGS. 3 through 5, the sign assembly 10 can be fitted with panel stabilizing clips 36 to prevent the sign panel 12 from swinging in the wind where such motion is undesired. The illustrated clips 36 are identical from side-to-side of the sign assembly 10. A clip 36 is an integral injection-molded part of polyvinylchloride or other thermoplastic material. The clip has an elongated bar 37, upstanding plate-like grips 38, an upstanding prong 39 and a vertically depending arm 40. The plates 38 alternately lie in laterally spaced planes parallel to the plane of the bar 37. The lateral spacing of the plates 38 is slightly less than the thickness of the sign panel 12 so that they frictionally grip the faces 31 of the panel. The upstanding prong or pin 39 extending vertically from the top edge of the bar 37 is adapted to fit snugly into one of the gaps between adjacent corrugation webs 21. In assembly, the prong 39 locks the panel 12 in the slot formed between laterally spaced plates 38. As shown, the prong 39 is centered on the plane between such laterally spaced plates 38.

The depending arm 40 has a vertical groove of generally circular cross-section. The cross-section of the groove 41 is shaped to fit around a respective leg 17 through an arc preferably greater than 180° and is proportioned to resiliently snap over the leg and snugly grip it. It will be seen that the prong 39 is at an end of the bar 37 opposite the end at which the leg gripping arm 40 exists. This construction reduces any concentration of stress on the sign panel 12 which might be imposed by the interconnection between the prong and the panel and the anchoring of the arm 40 on the leg 17.

Figure 6:
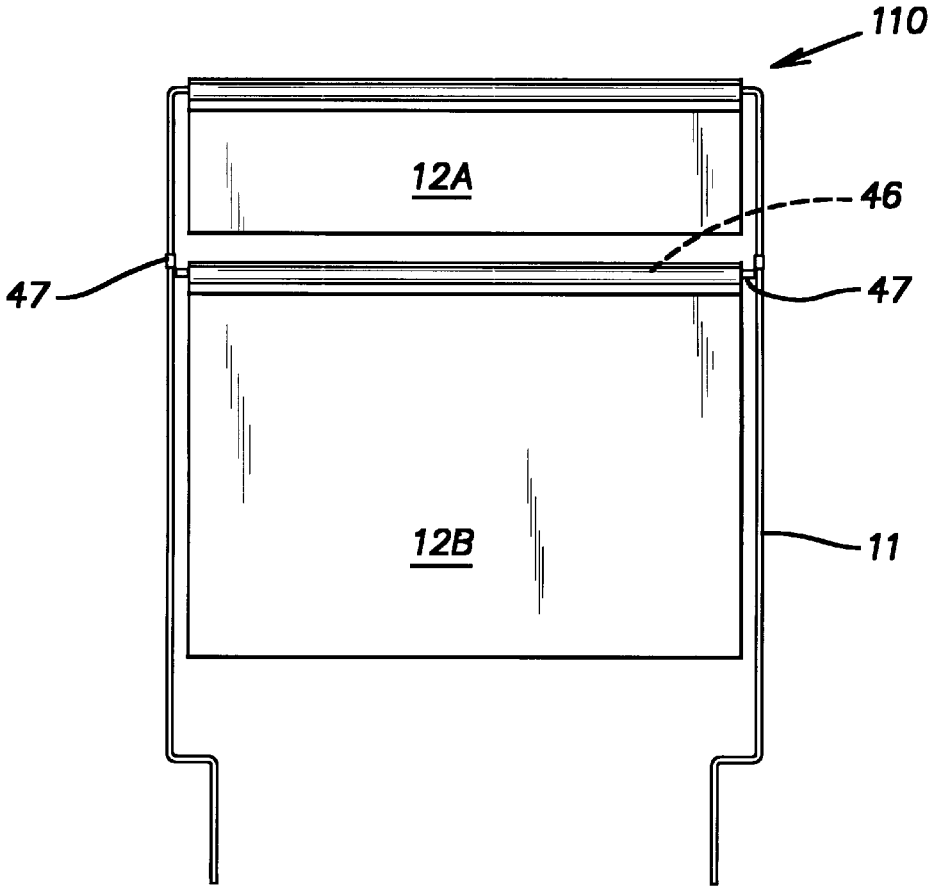
FIG. 6 is a second embodiment of the invention wherein two sign face panels are provided on a single frame.
Figure 7:
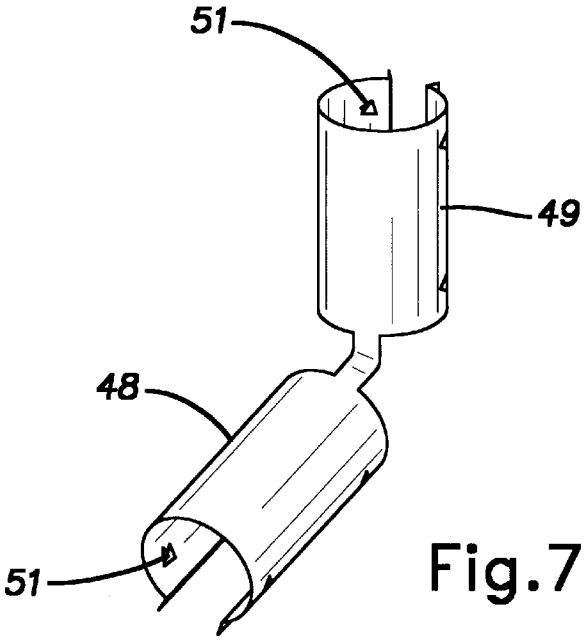
FIG. 7 is a perspective view of a clip used to assemble a cross-bar to the legs in the sign construction of FIG. 6.

With reference to FIG. 6, a sign assembly 110 can be provided with more than one sign panel. In this embodiment, elements which are like those described in connection with the first embodiment shown in FIGS. 1 through 5 have been given identical reference numerals. An upper sign panel 12A and a retaining channel 23 have a construction and an assembly on the frame 11 like that described in connection with FIG. 1. A cross bar 46 of material like that forming the frame 11 is secured on the frame in a horizontal position between the legs 17. This is accomplished by using connector brackets 47 shown in FIG. 7. The connector brackets are formed of spring steel or other suitable material. The connector brackets 47 have a portion 48 slid or snapped over the respective end of the cross bar 46 and another portion 49 snapped over a leg 17. The bracket 47 is suitably resilient and strong to maintain the cross bar 46 in a desired vertical location along the legs 17. Barbs 51 may be provided on the brackets 47 to enhance their grip on the legs 17 and cross bar 46. A second panel 12B is assembled on the auxiliary cross bar 46 with a channel 23 in the same manner as previously described in connection with the embodiment of FIG. 1. It will be understood that more than one auxiliary panel can be assembled on the frame 11 and that the frame can be proportionately elongated in the vertical direction to accommodate such additional panels.

The disclosed sign construction is economical to produce by virtue of its inexpensive componentry and minimal labor content. The assembly is light in weight and practical to ship when fully assembled. The sign is durable in use since it is resistant to damage from wind and impacts. The sign avoids risk to the user and general public since it avoids sharp edges and rigid projections. The assembly is particularly suited for shipment to local sign shops where it can have custom vinyl graphics applied to it, for example.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

I claim:

1. An outdoor sign comprising a metal frame and a thermoplastic sign panel, the frame having a horizontal header and spaced legs below the header, the legs having lower ends adapted to be driven into the ground, the sign panel being in the form of a flat generally rectangular sheet of substantially rigid corrugated stock having upper, lower and side edges, a retainer extending continuously along the upper edge of the panel for substantially the full length of such upper edge, the retainer being secured to the header in such a manner as to secure the sign panel to the header, the retainer being attached to the header substantially along the full length of the header, the retainer being sufficiently rigid and being configured to stiffen the panel substantially along the full length of the header, the retainer having a pair of opposed flanges proportioned and arranged to directly grin and thereby frictionally engage and retain opposite faces of the panel with sufficient retention to avoid the use of supplementary fasteners to maintain the panel connected to the header.

2. An outdoor sign as set forth in claim 1, wherein the frame is in a general shape of an inverted U.

3. An outdoor sign as set forth in claim 2, wherein the frame is bent into its shape from a continuous length of metal wire.

4. An outdoor sign comprising a metal frame and a thermoplastic sign panel, the frame having a horizontal header and spaced legs below the header, the legs having lower ends adapted to be driven into the ground, the sign panel being in the form of a flat generally rectangular sheet of corrugated stock having upper, lower and side edges, a retainer extending continuously along the upper edge of the panel for substantially the full length of such upper edge, the retainer being secured to the header in such a manner as to secure the sign panel to the header, the corrugations of the corrugated stock being generally vertical and perpendicular to the header and the retainer being arranged to stiffen the panel in the direction perpendicular to the corrugations.

5. An outdoor sign comprising a wire frame formed of a continuous length of wire having an inverted U-shape and lying in a plane, the frame including a horizontal header and vertical legs, a rectangular sign panel sized to frictionally fit within an area bounded by the frame, the sign panel being a sheet formed of thermoplastic material and having top, bottom and vertical edges, a channel retaining the panel on the frame, the channel extending around the frame header and having opposed flanges adapted to hold opposite sides of the panel along its upper edge without supplementary mechanical fasteners, the channel being proportioned to allow it and the panel to pivot about the longitudinal axis of the header.

6. An outdoor sign as set forth in claim 5, including an adhesive applied to a general area of contact between the channel and the upper edge of the panel.

7. An outdoor sign comprising a wire frame formed of a continuous length of wire having an inverted U-shape and lying in a plane, the frame including a horizontal header and vertical legs, a rectangular sign panel sized to fit within an area bounded by the frame, the sign panel being a sheet formed of thermoplastic material and having top, bottom and vertical edges, a channel retaining the panel on the frame, the channel extending around the frame header and having opposed flanges adapted to hold opposite sides of the panel along an upper edge, the channel being proportioned to allow it and the panel to pivot about the longitudinal axis of the header, the sign panel being a sheet of corrugated thermoplastic material, the corrugations extending perpendicularly to the longitudinal direction of the channel.

8. An outdoor sign as set forth in claim 7, wherein the channel is formed of resilient thermoplastic material and is proportioned to snap over the header and frictionally grip the upper edge of the panel.

9. An outdoor sign comprising a wire frame formed of a continuous length of wire having an inverted U-shape and lying in a plane, the frame including a horizontal header and vertical legs, a rectangular sign panel sized to fit within an area bounded by the frame, the sign panel being a sheet formed of thermoplastic material and having top, bottom and vertical edges, a channel retaining the panel on the frame, the channel extending around the frame header and having opposed flanges adapted to hold opposite sides of the panel along an upper edge, the channel being proportioned to allow it and the panel to pivot about the longitudinal axis of the header, and clip elements frictionally engaged with a lower portion of the panel and inter-engaged with the legs to prevent the panel from pivoting on the header.

10. An outdoor sign as set forth in claim 9, wherein the clip elements are provided adjacent each leg, each clip having opposed grips to engage an lower edge of the panel.

11. An outdoor sign as set forth in claim 10, wherein each clip has its grips arranged in a form of an interrupted channel.

12. An outdoor sign as set forth in claim 10, wherein each clip has an upstanding prong adapted to be received in the sign panel.

13. An outdoor sign as set forth in claim 12, wherein the prong of each clip is remote from the adjacent frame leg.

14. An outdoor sign as set forth in claim 13, wherein the clip has a socket-like groove dimensioned to snap onto an adjacent area of a frame leg.

15. An outdoor sign comprising a wire frame formed of a continuous length of wire having an inverted U-shape and lying in a plane, the frame including a horizontal header and vertical legs, a rectangular sign panel sized to fit within an area bounded by the frame, the sign panel being a sheet formed of thermoplastic material and having top, bottom and vertical edges, a channel retaining the panel on the frame, the channel extending around the frame header and having opposed flanges adapted to hold opposite sides of the panel along an upper edge, the channel being proportioned to allow it and the panel to pivot about the longitudinal axis of the header, a secondary horizontal header connected between the legs of the frame, a secondary panel below said secondary header and an extruded thermoplastic channel assembled over the secondary header and the secondary panel to retain said secondary panel on said secondary header.

16. A method of making an outdoor sign comprising bending a continuous steel wire into an inverted generally U-shaped frame such that the frame includes a generally horizontal header and spaced vertical legs depending from the header, providing a thermoplastic panel sized to fit within the U-shaped frame, joining the sign panel to the frame by positioning a thermoplastic elongated channel over the header after the frame has been formed into a U-shape and onto the sign panel in a manner wherein opposed flanges of the channel resiliently grip opposite faces of the panel without the need for separate fasteners while allowing the channel and sign panel to swing on the header and to add their strength to that of the frame header substantially continuously along the length of the header.

17. A method as set forth in claim 16, wherein the sign panel is provided in the form of a corrugated sheet with flutes forming the corrugations being perpendicular to the channel and header so that the channel reinforces the panel against bending about an axis parallel to the flutes.

* * * * *